US008657210B2

(12) United States Patent
Karunaratne et al.

(10) Patent No.: US 8,657,210 B2
(45) Date of Patent: Feb. 25, 2014

(54) CIRCULATING PAINT SYSTEMS

(75) Inventors: Nirupama Karunaratne, Alliston (CA); Carl Cave, Alliston (CA); Scott Johnson, Alliston (CA); Russell Woodhouse, Alliston (CA); Chika Sekine, Alliston (CA); Darin Long, Orangeville (CA)

(73) Assignee: Honda Motor Co., Ltd. (JP)

( * ) Notice: Subject to any disclaimer, the term of this patent is extended or adjusted under 35 U.S.C. 154(b) by 870 days.

(21) Appl. No.: 12/395,331

(22) Filed: Feb. 27, 2009

(65) Prior Publication Data

US 2010/0200667 A1 Aug. 12, 2010

(30) Foreign Application Priority Data

Feb. 6, 2009 (CA) ..... 2653188

(51) Int. Cl.
*B05B 9/00* (2006.01)

(52) U.S. Cl.
USPC ..... 239/124; 239/127

(58) Field of Classification Search
USPC ..... 239/127, 124, 600, DIG. 14, 525, 526
See application file for complete search history.

(56) References Cited

U.S. PATENT DOCUMENTS

| | | | | |
|---|---|---|---|---|
| 2,022,481 | A | | 11/1935 | Schellenger |
| 2,461,766 | A | | 2/1949 | Peeps |
| 2,546,741 | A | | 3/1951 | Grossman |
| 2,590,442 | A | | 3/1952 | Miller et al. |
| 2,604,854 | A | | 7/1952 | Taylor |
| 2,754,228 | A | | 7/1956 | Bede |
| 3,498,260 | A | | 3/1970 | De Jean et al. |
| 3,720,373 | A | | 3/1973 | Levey |
| 4,085,892 | A | * | 4/1978 | Dalton ..... 239/707 |
| 4,243,527 | A | | 1/1981 | Leonard |
| 4,392,336 | A | | 7/1983 | Ganssle |
| 4,392,366 | A | | 7/1983 | Godfrey |
| 4,561,380 | A | | 12/1985 | Mulder et al. |
| RE32,151 | E | | 5/1986 | Scharfenberger |
| 4,592,305 | A | | 6/1986 | Scharfenberger |
| 4,923,720 | A | | 5/1990 | Lee et al. |
| 5,078,084 | A | | 1/1992 | Shutic et al. |
| 5,171,613 | A | | 12/1992 | Bok et al. |
| 5,195,680 | A | * | 3/1993 | Holt ..... 239/124 |
| 5,312,862 | A | | 5/1994 | Nielsen et al. |
| 5,418,271 | A | | 5/1995 | Burba, III et al. |
| 5,501,397 | A | * | 3/1996 | Holt ..... 239/124 |
| 5,549,755 | A | | 8/1996 | Milovich et al. |

(Continued)

FOREIGN PATENT DOCUMENTS

| | | |
|---|---|---|
| JP | 06181407 | 8/1994 |

*Primary Examiner* — Davis Hwu
(74) *Attorney, Agent, or Firm* — Standley Law Group LLP

(57) ABSTRACT

A painting system for painting a plurality of colours comprises a plurality of paint supply networks and a plurality of paint return networks, each network for a corresponding paint colour. A number of paint delivery stations are also provided, each including a plurality of drop lines. Each drop line is in communication with a corresponding paint supply network. Each drop line includes a downstream end coupling. Each paint delivery station includes a plurality of paint return nodes, each in communication with a corresponding paint return network. A paint gun unit is provided with a paint gun supply coupling. The paint gun supply coupling is complementary with each of the downstream end couplings of a corresponding drop line. The downstream end coupling of each drop line is uniquely shaped to engage only with the correct paint return node.

2 Claims, 4 Drawing Sheets

(56) References Cited

U.S. PATENT DOCUMENTS

| | | | | | |
|---|---|---|---|---|---|
| 5,759,277 | A | | 6/1998 | Milovich et al. | |
| 5,823,438 | A | * | 10/1998 | Holt | 239/127 |
| 5,997,692 | A | | 12/1999 | Taylor et al. | |
| 6,036,107 | A | * | 3/2000 | Aspen et al. | 239/170 |
| 6,164,558 | A | | 12/2000 | Holt | |
| 6,361,605 | B1 | | 3/2002 | Shutic et al. | |
| 6,395,406 | B1 | | 5/2002 | Sangeeta | |
| 7,293,720 | B2 | | 11/2007 | Ramsay | |
| 2002/0014496 | A1 | | 2/2002 | Cline et al. | |

* cited by examiner

CIRCULATING PAINT SYSTEMS

CROSS-REFERENCE TO RELATED APPLICATIONS

As authorized by 35 U.S.C. §119, this application claims priority to and hereby incorporates by reference Canadian Application Serial No. 2,653,188, titled CIRCULATING PAINT SYSTEMS, filed on Feb. 6, 2009.

FIELD OF THE INVENTION

The present invention relates to painting lines in manufacturing installations.

DESCRIPTION OF THE RELATED ART

Painting is a key step in most manufacturing processes. It is common to use bulk supply stations which deliver different colours of paint in separate supply and return networks. A number of paint supply stations are then located downstream of the paint supply network and are equipped with a supply node and a return node for each colour. A generic paint drop line is usually provided to join any one of the nodes to a paint gun. A typical paint drop line may be twenty feet long to provide sufficient reach from the nodes to the workpiece. This means that the paint drop line and the gun must be cleaned between paint colours, involving excessive amounts of cleaning solvents and time.

It would be desirable to provide a novel approach to alleviating this problem.

SUMMARY OF THE GENERAL INVENTIVE CONCEPT

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless otherwise indicated, the term "or" is to be considered inclusive. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention. However, other alternative mechanical configurations are possible which are considered to be within the teachings of the instant disclosure.

In one exemplary embodiment, there is provided a painting system for painting a plurality of colours, comprising a plurality of paint supply networks and a plurality of paint return networks, each network for a corresponding paint colour. A number of paint delivery stations are also provided, each including a plurality of drop lines, each drop line in communication with a corresponding paint supply network. Each drop line includes a downstream end coupling, while each paint delivery station includes a plurality of paint return nodes, each of which are in communication with a corresponding paint return network. A paint gun is also provided and includes a paint gun supply coupling. The paint gun supply coupling is complementary with each of the downstream end couplings of a corresponding drop line. The downstream end coupling of each drop line is also uniquely shaped to engage only with the correct paint return node.

In an exemplary embodiment, for a first paint colour, each first downstream end coupling and corresponding first return node include one of a first pair of uniquely complementary guide portions. The guide portions are arranged to engage prior to or at engagement of the first downstream end coupling and the first return node. For a second paint colour, each second downstream end coupling and corresponding second return node includes one of a second pair of uniquely complementary guide portions. The guide portions are arranged to engage prior to or at engagement of the second downstream end coupling and the second return node.

In an exemplary embodiment, the first guide portions include a first male guide element and a complementary first female guide element. In turn, the second guide portions include a second male guide element and a complementary second female guide element. In an example, the first male guide element includes a first plate member with an outer periphery with a first predetermined shape, while the first female guide element includes a first housing portion with a first opening with a shape which is complementary to the first predetermined shape. In an example, the second male guide element further includes a second plate member with an outer periphery of a second predetermined shape. The second female guide element includes a second housing portion with a second opening of a shape that is complementary to the second predetermined shape.

In an exemplary embodiment, each paint delivery station includes each of the first and second return nodes being adjacent one another. The first and second housing portions are included in a common housing panel. The housing panel includes the first and second windows, wherein the first downstream end coupling is passed through the first window and the second downstream end coupling is passed through the second window.

In another exemplary embodiment, there is provided a paint delivery station which comprises a plurality of paint supply nodes, each for delivering a different colour to the paint delivery station. A plurality of drop lines are also provided, each of which is in communication with a corresponding paint supply node. Each drop line includes a downstream end coupling. Also provided are a plurality of paint return nodes, each of which is arranged to receive a corresponding downstream end coupling. The drop lines thus establish, in one phase, a paint recirculation network from a paint supply station to the paint supply node, through the drop line, through the paint return node and back to the paint supply station. Also provided is a paint gun unit with a paint gun supply coupling. The paint gun supply coupling is arranged to receive any one of the remote end couplings on a corresponding drop line, in order to receive, in a paint delivery phase, a supply of paint of a particular colour therein. The downstream end coupling of each drop line is further uniquely arranged to engage only with the correct paint return node to maintain effective separate paint recirculation networks for each colour. The patent delivery station is still further arranged, in an operative mode, to maintain each paint recirculation network in an active state, except for a designated drop line end coupling to be engaged with the paint gun supply coupling in the paint delivery phase for the designed colour.

In still another exemplary embodiment, there is provided a method of delivering paint to a paint gun on a painting line, comprising:

providing a plurality of paint supply networks and a plurality of paint return networks, each corresponding paint supply network and paint return network for a predetermined colour;

providing a paint line with a number of paint delivery stations;

providing, at each paint delivery station, a plurality of active paint supply nodes, each paint supply node in communication with a corresponding paint supply network for delivering a paint of a predetermined colour to the paint delivery station, providing, at each paint delivery station, a plurality of active drop lines, and joining each drop line with a corresponding active paint supply node, providing, at each paint delivery station, a plurality of active paint return nodes, each paint return node in communication with a corresponding paint return network;

providing each active drop line with a downstream end coupling, and configuring the downstream end coupling of each drop line so that it can engage with only one matching active paint return node;

providing a paint gun unit with a paint gun supply coupling which is operable to engage the downstream end of each active drop line configuring the paint gun supply coupling being arranged to receive any one of the remote end couplings on a corresponding active drop line, in order to receive, in a paint delivery phase, a supply of paint of a particular colour therein;

Thus, in the exemplary embodiment as described above, the downstream end coupling of each active drop line is uniquely arranged to engage only with the correct paint return node to maintain effective separate paint recirculation networks for each colour. Further, the paint delivery station is further arranged, in an operative mode, to maintain each paint recirculation network with a positive flow of paint therethrough, except for a designated active drop line end coupling to be engaged with the paint gun supply coupling in the paint delivery phase for the designed colour.

In still another exemplary embodiment, there is provided a multi-colour painting system, comprising two or more sections for two or more colours. For a first colour, there is provided a first paint supply station and a first supply line in communication with the first paint supply station. A number of paint delivery stations are also provided in communication with the first supply line and downstream from the first paint supply station. A first return line is in communication with the paint delivery stations. The first supply line includes a plurality of first supply nodes, each for a corresponding paint delivery station. The first return line includes a plurality of first return nodes, each for a corresponding paint delivery station. Each first supply node includes a first supply coupling and the return node including a first return coupling. A first drop line is also provided having a first upstream end coupling which is complementary with the first supply coupling and a first downstream end coupling which is complementary with the first return coupling. Together, the first supply line, the first drop line and the first return line are operable in a recirculation phase to form a recirculation path from the first supply station and along the first supply line, through the first supply node, along the first drop line, through the first return node and along the first return line back to the supply station, A paint gun assembly is also provided with a paint gun supply coupling which is complementary with the first downstream end coupling. The first supply line and the first drop line, in a delivery phase, form a paint delivery path from the first supply station and along the first supply line to the first supply node, through the first drop line to the paint gun assembly, the first downstream end coupling being uniquely complementary with the first return node and the paint gun assembly. For a second colour; there is provided a second paint supply station including a second supply line, which is in communication with the second paint supply station. The second paint delivery station is arranged to be communication with the second supply line and downstream from the second paint supply station. A second return line is arranged in communication with the paint delivery stations. The second supply line includes a plurality of second supply nodes, each for a corresponding paint delivery station. The second return line also includes a plurality of second return nodes, each for a corresponding paint delivery station. Each second supply node includes a second supply coupling and the second return node includes a second return coupling. A second drop line is also provided which has a second upstream end coupling which is complementary with the second supply coupling and a second downstream end coupling which is complementary with the second return coupling. Together, the second supply line, the second drop line and the second return line are operable in a recirculation phase to form a recirculation path from the second supply station and along the second supply line, through the second supply node, along the second drop line, through the second return node and along the second return line back to the second supply station. The second supply line and the second drop line also provide a delivery phase to form a paint delivery path from the second supply station and along the second supply line to the second supply node, through the second drop line to the paint gun assembly, the second downstream end coupling being uniquely complementary to the second return node and the paint gun assembly.

In an exemplary embodiment, for the first paint colour, each first downstream end coupling and corresponding first return node include one of a first pair of uniquely complementary guide portions. In the case of the first colour, the guide portions are arranged to engage prior to or at engagement of the first downstream end coupling and the first return node. Further, for the second paint colour, each second downstream end coupling and corresponding second return node include one of a second pair of uniquely complementary guide portions. In the case of the second colour, the guide portions are arranged to engage prior to or at engagement of the second downstream end coupling and the second return node.

In an exemplary embodiment, the first guide portions include a first male guide element and a complementary first female guide element, while the second guide portions include a second male guide element and a complementary second female guide element. The first male guide element may include, for instance, a first plate member with an outer periphery with a first predetermined shape, while the first female guide element may thus include a first housing portion with a first opening with a shape that is complementary to the first predetermined shape. Meanwhile, the second male guide element may include a second plate member with an outer periphery with a second predetermined shape, while the second female guide element may include a second housing portion with a second opening with a shape that is complementary to the second predetermined shape.

In an exemplary embodiment, each paint delivery station is arranged so that each of the first and second return nodes are adjacent one another. The first and second housing portions are included in a common housing panel, which presents both the first and second windows. In this case, the first downstream end coupling is arranged to be passed through the first window and the second downstream end coupling is arranged to be passed through the second window.

In still another exemplary embodiment, there is provided a method of coating articles with a plurality of colours, comprising:

providing a plurality of coating supply networks and a plurality of coating return networks, each network for a corresponding coating colour, providing a plurality of coating delivery stations for coating the articles in succession, each with a plurality of drop lines, each drop line in communication with a corresponding paint supply network, providing each drop line with a downstream end coupling, providing each coating delivery station with a plurality of coating return nodes, each in communication with a corresponding coating return network, providing a coating gun unit with a coating gun supply coupling, the coating gun supply coupling being complementary with the downstream end coupling for the drop line of each colour, the downstream end coupling of each drop line uniquely configured to engage with only the coating return node of the same coating colour.

In still another exemplary embodiment, there is provided a method of coating articles with a plurality of colours, comprising:

providing a coating station with a plurality of drop lines, each in communication with a corresponding paint supply line for a particular colour, providing a coating gun with a gun supply coupling;

providing a downstream end region on each drop line with a coupling which matches the gun supply coupling for fluid communication therebetween;

providing a plurality of coating return nodes, each in fluid recirculating communication with a corresponding coating return line for a given colour, with each return node accessible by only the drop line carrying the given colour;

initiating a first colour coating sequence with all active drop lines in a recirculation arrangement with each drop line coupled with a corresponding return node;

selecting a first colour for coating an article and selecting a first drop line corresponding to the selected first colour;

disconnecting the selected first drop line from the corresponding return node;

connecting the gun supply coupling with the selected first drop line;

carrying out the first colour coating sequence with the gun directed at one or more articles, in successive groups of one or more;

and when the first colour coating sequence is complete, disconnecting the gun supply coupling from the first selected drop line;

reaccessing the corresponding return node with the selected first drop line and establishing recirculating fluid communication therewith;

cleaning the coating gun;

initiating a second colour coating sequence with all active drop lines in a recirculation arrangement with each drop line coupled with a corresponding return node;

selecting a second colour for coating an article and selecting a second drop line corresponding to the selected second colour;

disconnecting the selected second drop line from the corresponding return node;

connecting the gun supply coupling with the selected second drop line;

carrying out the second colour coating sequence with the gun directed at one or more articles, in successive groups of one or more;

and when the second colour coating sequence is complete, disconnecting the gun supply coupling from the second selected drop line;

reaccessing the corresponding return node with the selected second drop line and establishing recirculating fluid communication therewith; and cleaning the coating gun.

In still another exemplary embodiment, there is provided a coating assembly for coating an article with one or more of a plurality of available colours. The coating assembly comprising a console to locate a plurality of drop lines and a corresponding plurality of return node portions. Each drop line is in fluid communication with a corresponding supply line for one colour, while each return node portion is in fluid communication with a corresponding return line for one colour. Each drop line has an end region which is arranged for fluid recirculating communication with only one matching return node portion to form a matched coupling for a predetermined colour. And for each matched coupling, the console includes a first barrier formation and the end region of the drop line includes a second barrier formation. The first and second barrier formations are thus arranged to engage one another and thereby permit access of the end region to the return node.

In yet another exemplary embodiment, there is provided a drop line for use in a coating assembly for coating an article, of the type having a console for controlling access to a matching return node for establishing recirculating communication between the drop line and a coating supply network, the console having a predetermined first barrier formation for controlling access of the drop line to the matching return node. The drop line thus comprises a first end region for fluid communication with a supply line and a second end region. The second end region has a second barrier formation. The first predetermined barrier formation and the second barrier formation are engageable with one another to permit unrestricted access of the end region to the matching return node.

In yet another exemplary embodiment, there is provided an article coated by the method herein above. In one exemplary embodiment, the article is an automotive vehicle.

BRIEF DESCRIPTION OF THE DRAWINGS

Several preferred embodiments of the present invention will be provided, by way of examples only, with reference to the appended drawings, wherein.

DETAILED DESCRIPTION OF EXEMPLARY EMBODIMENTS

Figure 1:
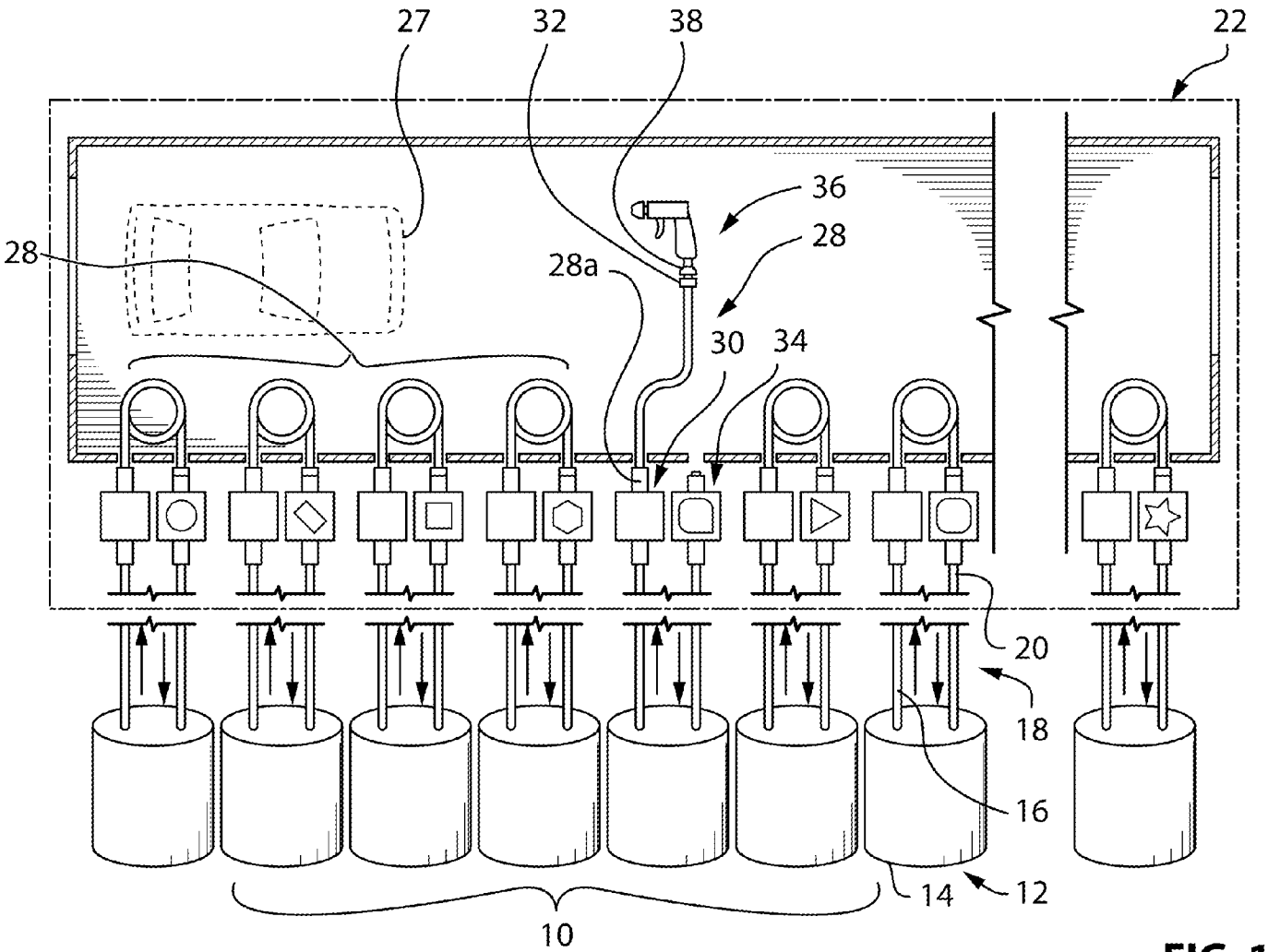
FIG. 1 is a schematic view of a painting system.

Referring to the figures, there is provided a painting system 10 for painting a plurality of colours. The painting system includes a plurality of paint supply networks 12 which are schematically represented by a body representative of a supply tank 14 (including a pump assembly not shown) and a supply line 16 leaving the supply tank 14. Also provided is a plurality of paint return networks 18 schematically represented by a return line 20 approaching the supply tank 14. A number of identical supply networks 12 and return networks 18 are shown, each one for a corresponding paint colour.

Figure 1A:
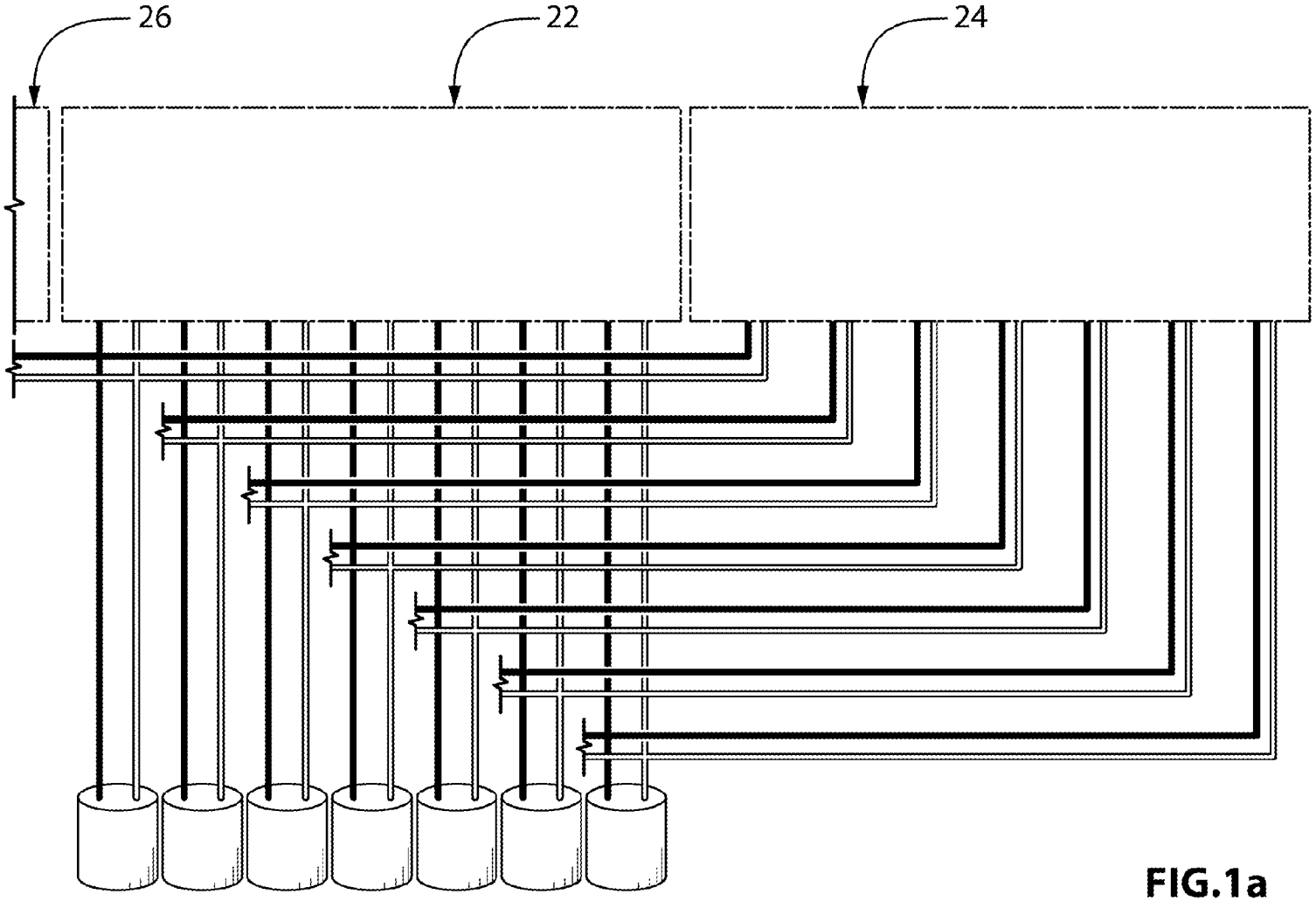
FIG. 1*a* is another schematic view of the painting system of FIG. 1.
Figure 2:
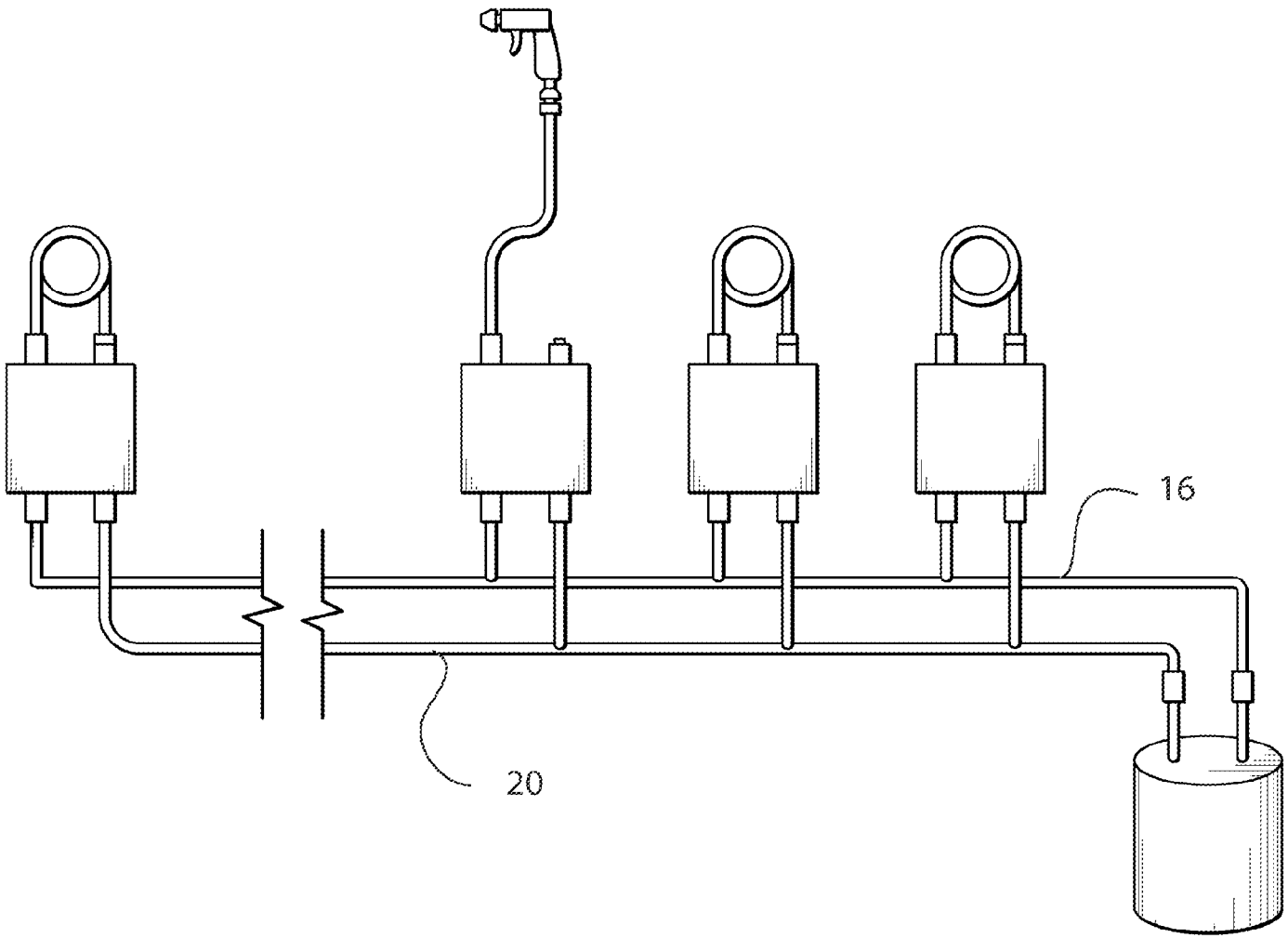
FIG. 2 is an expanded schematic view of a supply and return network portion of the system of FIG. 1.

A number of paint delivery stations are also provided. In this case, one such paint delivery station is shown at 22 in FIGS. 1 and 1*a* while FIG. 1*a* also shows two other paint delivery stations 24 and 26, all being supplied by the paint supply and return networks 12, 18. FIG. 2 illustrates how a single paint colour is distributed through several paint supply stations.

Each paint delivery station 22 is dimensioned to receive work pieces shown in dashed lines at 27 to be painted either in single file or in batches of two or more. One such work piece 27 is an automotive vehicle chassis, in which case the paint delivery station is stationed on an automotive assembly line. Each paint delivery station includes a plurality of drop lines 28. Each drop line has an upstream end 28*a*, which is coupled with a corresponding paint supply network 12 at a supply node 30 and includes a downstream end coupling 32.

Each of the paint supply nodes 30 are in communication with a corresponding supply line 16, while a plurality of paint return nodes are provided at 34, each in communication with a corresponding paint return network 18. A paint gun unit is shown at 36 with a paint gun supply coupling 38. The paint gun supply coupling 38 is complementary with each of the downstream end couplings 32 of the corresponding drop lines 28 so that any one of the drop lines 28 may be coupled to the paint gun 36 depending on the desired paint colour to be applied at a particular painting interval. FIG. 1 thus shows the drop lines 28 in the paint supply station 22 in two possible positions. In one position, the downstream end coupling 32 is engaged with its matching return node 34 (referred to below as the "recirculation mode"). In another position, the downstream end coupling 32 is engaged with the paint gun supply coupling 38 (referred to below as the "painting mode").

A particular feature of the paint delivery station 22 is that the downstream end coupling 32 of each drop line 28 is uniquely shaped to engage only with the correct paint return node 34.

Figure 3:
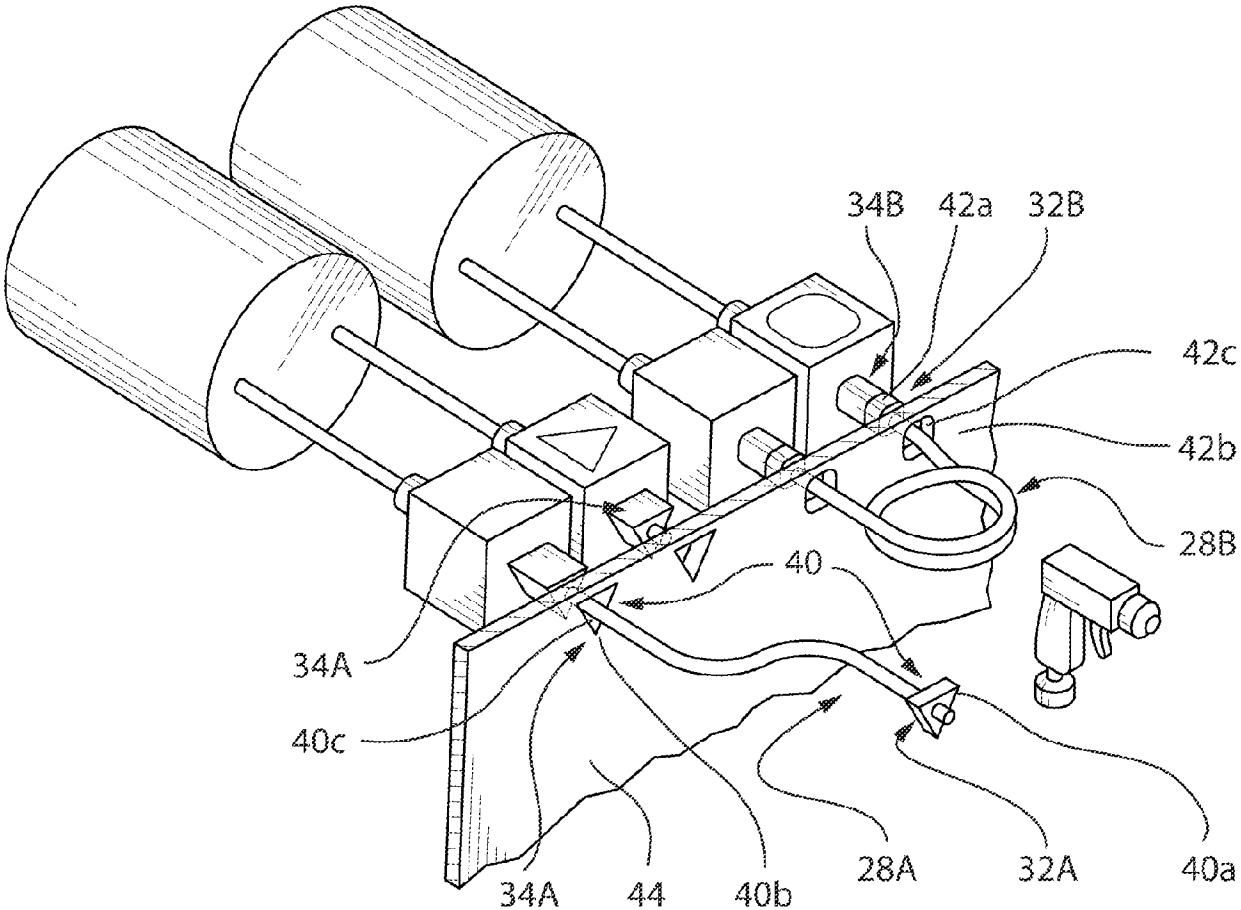
FIG. 3 is a fragmentary perspective view of a paint supply station portion of the system of FIG. 1.

FIG. 3 shows two drop lines. Considering the left hand drop line 28A for a first paint colour, it can be seen that the first downstream end coupling 32A and the corresponding first return node 34A include a first pair of uniquely complementary "triangular" guide portions 40. The first pair of guide portions are arranged to engage prior to or at the engagement of the first downstream end coupling and the first return node. The first guide portions 40 include a first male guide element 40*a*, in the form of a first plate member with an outer periphery with a first predetermined shape, in this case formed as a triangle. A complementary first female guide element 40*b* is thus also provided and, in this example, is included in a first panel portion to form a first opening or "window" 40*c* with a shape which is complementary to the first predetermined shape, in this case again as a triangle. Now, considering the right hand drop line 28B, the second downstream end coupling 32B and the corresponding second return node 34B include a second pair of uniquely complementary "rounded-rectangular" guide portions, which are provided by a rounded rectangular second plate member 42*a* and a complementary second female guide element 42*b* as a second panel portion, again with a second rounded rectangular opening or "window" 42*c*.

For each of the first and second downstream end couplings 32, in order to be reattached to the proper return nodes 34, they must pass through the correct window 40*c*, 42*c*, thus ensuring that the drop line 28A of the first colour will always be coupled with the return node 34 of the first colour, eliminating colour contamination that would otherwise occur were the return nodes and/or the downstream end couplings switched.

In this example the first and second panel portions are included in a common panel 44, thereby providing a console for convenient organization of the drop lines 28, though the first and second panel portions may be provided in separate panels, housing's or other couplings and/or fixtures, as desired. While the drop lines 28 are shown in a loop configuration, this is merely for illustration and may be provided of various lengths as desired.

Thus, the paint system may be operated by activating the supply networks 12 for delivering a supply of different colours of paint, each in its own supply network 12. Paint drop lines 28 may then be provided as desired. For instance, some paint delivery stations may not need all paint colours. Therefore, each paint delivery station is configured with paint drop lines 28 on the corresponding paint supply nodes 30 for each of the paint colours to be utilized and initially in their recirculation mode.

A painting associate may then initiate the process by grasping the paint gun 36 in a clean condition and selecting a first colour, thus identifying the corresponding paint drop line. This may be provided by labels on the panel 44 indicating the colour, by name and/or stock code in human or machine readable form. The painting associate then reaches through the corresponding window to grasp the corresponding first paint drop line 28A, or alternatively grasps the paint drop line 28A on an outer portion thereof that is exterior of the panel 44, to disconnect the downstream end coupling 32A from the matching paint return node 34A.

The painting associate then couples the downstream end coupling 32A with the paint gun supply coupling 38 and proceeds to apply paint of the first designated colour on a work piece 27. When painting with the first designated colour is complete, the painting associate reengages the downstream end coupling 32A of the first paint drop line to the matching paint return node 34A by first passing the first male guide element 40*a* through the matching first window 40*c*.

The painting associate then cleans the paint gun 36 by passing a solvent or other cleaning mixture in liquid, fluid or a gaseous state under pressure therethrough. However, in this step, the painting associate does not need to clean the drop line 28. Instead, it is now continuing its function in the recirculation mode to recirculate paint through the matching paint supply and return networks 12, 18. Thus, the amount of solvent and time need for the cleaning task is substantially limited to the cleaning of the paint gun 36. Of course, the cleaning step may also be done offline by providing the painting associate with a supply of clean paint guns in order to minimize operational delays between colours.

With a clean paint gun in hand, the painting Associate identifies the second paint colour and identifies the corresponding paint drop line 28. The painting Associate then disconnects the second downstream end coupling 32B from the matching paint return node 34B. The painting Associate then couples the downstream end coupling 32B with the paint gun supply coupling 38 and then proceeds to apply paint of the second colour on the work piece.

Thus, the painting system 10 may, in one example, provide a method of circulating paint that is in a dead-end tube. The system allows for a paint drop line (or paint tube) to be removed from the matching return drop and to then be connected to the gun for a painting procedure. At the end of painting procedure, the paint tube may be removed from the paint spray gun and reconnected to its return paint drop without requiring cleaning of the paint tube.

While the present invention has been described by way of several specific but exemplary embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A painting system for painting a plurality of colors, comprising a plurality of paint supply networks and a plurality of paint return networks, each network for a corresponding paint color, a number of paint delivery stations, each including a plurality of drop lines, each drop line in communication with a corresponding paint supply network, each drop line including a downstream end coupling, each paint delivery station including a plurality of paint return nodes, each in communication with a corresponding paint return network, a paint gun unit with a paint gun supply coupling, the paint gun supply coupling being complementary with each of the downstream end couplings of a corresponding drop line, the downstream end coupling of each drop line uniquely shaped to engage only with the correct paint return node, wherein for a first paint color, each first downstream end coupling and corresponding first return node includes one of a first pair of uniquely complementary guide portions, the guide portions being arranged to engage prior to or at engagement of the first downstream end coupling and the first return node, and wherein, for a second paint color, each second downstream end coupling and corresponding second return node includes one of a second pair of uniquely complementary guide portions, the guide portions being arranged to engage prior to or at engagement of the second downstream end coupling and the second return node, the first guide portions including a first male guide element and a complementary first female guide element; the second guide portions including a second male guide element and a complementary second female guide element, the first male guide element including a first plate member with an outer periphery with a first predetermined shape, the first female guide element including a first housing portion with a first opening with a shape that is complementary to the first predetermined shape, the second male guide element including a second plate member with an outer periphery with a second predetermined shape, the second female guide element including a second housing portion with a second opening with a shape that is complementary to the second predetermined shape.

2. The system of claim 1, wherein each paint delivery station is arranged so that each of the first and second return nodes are adjacent one another, the first and second housing portions are included in a common housing panel, the housing panel including first and second windows, wherein the first downstream end coupling is arranged to be passed through the first window and the second downstream end coupling is arranged to be passed through the second window.

* * * * *